United States Patent [19]

Staudinger

[11] 3,989,444

[45] Nov. 2, 1976

[54] GAS BURNER AND PROCESS FOR THE PARTIAL COMBUSTION OF A GASEOUS FUEL

[75] Inventor: Gernot Staudinger, Amsterdam, Netherlands

[73] Assignee: Shell Oil Company, Houston, Tex.

[22] Filed: Dec. 9, 1974

[21] Appl. No.: 530,645

[30] Foreign Application Priority Data

Dec. 20, 1973 Netherlands ..... 7317443

[52] U.S. Cl. ..... 431/181; 431/177; 239/405; 239/425

[51] Int. Cl.[2] ..... F23D 15/00

[58] Field of Search ..... 431/174, 177, 183, 184, 431/353, 181; 239/405, 406, 425

[56] References Cited

UNITED STATES PATENTS

| | | | |
|---|---|---|---|
| 1,938,335 | 12/1933 | Hubbard et al. | 431/174 |
| 2,935,128 | 5/1960 | Ferguson | 431/174 |
| 3,244,220 | 4/1966 | Kloecker | 431/177 |
| 3,861,858 | 1/1975 | Hemsath et al. | 431/174 |
| 3,880,571 | 4/1975 | Koppang et al. | 431/177 |

FOREIGN PATENTS OR APPLICATIONS

| | | | |
|---|---|---|---|
| 1,157,333 | 11/1963 | Germany | 431/353 |

*Primary Examiner*—Carroll B. Dority, Jr.

[57] ABSTRACT

A gas gun for producing a hydrogen and carbon monoxide rich reduction gas by partially combusting a gaseous fuel. The tip of the gas gun is provided with at least two groups of radially-directed gas discharge nozzles, the nozzles of one group having a larger diameter than those of the other group.

5 Claims, 12 Drawing Figures

GAS BURNER AND PROCESS FOR THE PARTIAL COMBUSTION OF A GASEOUS FUEL

BACKGROUND OF THE INVENTION

The invention relates to a gas burner comprising a burner gas, an air chamber around the gun and a combustion chamber, which air chamber debouches into the combustion chamber via an annular combustion mouth, the burner gun having a cylindrical barrel for the supply of gaseous fuel to the combustion chamber through the said combustion mouth and the annular combustion mouth having a convergent and divergent inner wall located on either side of a restriction situated outside the front end of the barrel of the burner gun.

In gas burners as defined, the gaseous fuel usually leaves the barrel via a slit provided therein, which slit is directed radially, i.e. outward, the barrel is usually double-walled, so that an ignition pilot burner may optionally be provided within the barrel.

A gas burner of this type may, for example, be used for the partial combustion of a gaseous fuel, in which the combustion gas obtained contains inter alia hydrogen and carbon monoxide. Such gases can be used, for example, for the synthesis of methanol or ammonia, for the reduction of sulphur compounds, or for treating petroleum fractions.

For the above application the burner is usually installed on a reactor lined with fire bricks, in which reactor the combustion gases have a certain residence time - which contributes to a fuller conversion of the fuel and diminishes the possibility of soot formation. The combustion chamber of the gas burner directly communicates with the reactor and serves to extend the residence time of gas and oxygen. The good mixing of these two latter components in the combustion chamber of the gas burner contributes to a suppression of the soot formation and renders operation at a low oxygen/fuel ratio possible, so that the hydrogen and carbon monoxide percentage in the combustion gas is high and the water and carbon dioxide percentage therein low.

It has already been proposed to improve the operation of the burner by blowing oxygen or an oxygen-containing gas such as air, tangentially into the air chamber, so that oxygen or air on its way to the combustion mouth moves in a helix round the barrel of the burner gun. The helical movement continues in the combustion chamber and contributes to a good mixing of oxygen and gaseous fuel.

By the combined use of the combustion chamber with the design of the burner gun as mentioned above, not only the above-mentioned helical vortex in the combustion chamber but also a loop-shaped recirculation of the reacting gases and their combustion products from the flame to the combustion mouth is obtained, which increases the residence time and consequently suppresses soot formation. Especially the shape of the combustion mouth and the location of the barrel of the burner with respect to the restruction of the combustion mouth contribute to the occurrence of this loop-shaped recirculation. As a result of the shape of the combustion mouth air or oxygen and the gaseous fuel flow into the combustion chamber in a fan-shaped pattern.

SUMMARY OF THE INVENTION

The object of the invention is to provide means by which the possibility of soot formation in partially combusting a gaseous carbonaceous fuel in a gas burner of the above-mentioned type is further reduced and whereby it will be possible to operate the burner at a lower oxygen/fuel ratio and/or a lower load without any soot formation.

The invention therefore relates to a gas burner comprising a burner gun, an air chamber around the gun and a combustion chamber, which air chamber debouches into the combustion chamber via an annular mouth, the burner gun having acylindrical barrel for the supply of gaseous carbonaceous fuel to the combustion chamber through the said combustion mouth and the annular combustion mouth having a convergent and divergent inner wall located on either side of a restriction situated outside the front end of the barrel of the burner gun, in which gas burner radial outflow nozzles of different diameter are provided near the combustion mouth, in the side wall of the burner near the closed front end of the barrel, which nozzles serve to dose gaseous fuel into the oxygen or oxygen-containing gas flowing through the combustion mouth, the nozzles being regularly or substantially regularly distributed according to size around the barrel.

By a regular distribution according to size is meant that two or more nozzles of the same diameter are provided regularly in the gun barrel. In this distribution deviations up to a maximum of about 10% of the theoretically obtainable geometrical regularity are permitted.

It has been found that the provision of radial outflow nozzles of different diameter results in a very intimate mixing of air or oxygen and gaseous fuel, especially as a result of the discontinuous character of the introduction of the gases concerned - viewed along the circumference of the barrel of the burner gun. By this provision it is prevented that the gaseous fuel supplied centrally is forced away from the wall of the combustion mouth by the surrounding air or oxygen stream and that it flows as a separate unmixed stream into the combustion chamber.

An excellent mixing of air or oxygen and gaseous fuel is obtained when all the outflow nozzles are located in one single plane which is perpendicular to the axis of the burner.

The location of the outflow nozzles on the barrel of the burner gun with respect to the restriction of the annular combustion mouth is of great importance for obtaining a functional flow pattern. A correct location of these outflow nozzles consequently contributes to the good mixing of air or oxygen and the gaseous fuel.

According to the preferred embodiment of the invention, for this purpose the ratio between the diameter of the said restriction and the distance from the plane through the outflow nozzles to the plane through the restriction is between 1.5 and 1.7.

Further, it is of importance that the front-end of the gun barrel does not impede the flow too much, so that the distance between the plane through the outflow nozzles and the plane through the front end of the burner gun should be kept small.

According to the invention it is therefore preferably ensured that the ratio between the distance from the plane through the front end of the barrel to the plane through the outflow nozzles and the diameter of the restriction lies between 0.097 and 0.117.

Further, it is preferably ensured that the ratio between the diameter of the barrel and the diameter of the restriction lies between 0.60 and 0.67. The ratio between the diameter of the outflow nozzles and the diameter of the restriction is preferably between 0.030 and 0.060.

In a simple but efficient embodiment of the invention two groups of outflow nozzles are provided, each group having a different nozzle diameter. It is possible, for example, to distribute these outflow nozzles alternately and regularly along the circumference of the barrel of the burner gun.

It is preferred that a group of at least six outflow nozzles with a smaller diameter and a group of at least six outflow nozzles with a larger diameter are provided. Although the effect of the provision according to the invention already becomes noticeable with a smaller total number of outflow nozzles, the effect is generally most manifest if twelve or more outflow nozzles in total are provided.

In the application of two groups of outflow nozzles it is preferably ensured that the ratio between the diameter of the larger outflow nozzles and the diameter of the restruction is between 0.045 and 0.050 and that the ratio between the diameter of the smaller outflow nozzles and the diameter of the restriction is between 0.034 and 0.040.

The ratios with respect to nozzle diameter and diameter of the restriction depend to a large extent on the pressure at which air or oxygen and the gaseous fuel are available and the velocities of air or oxygen and of gaseous fuel required for a good mixing in the burner.

The invention also relates to a process for the preparation of a soot-free hydrogen- and carbon monoxide-containing gas mixture by the partial combustion of a gaseous carbonaceous fuel with oxygen or an oxygen-containing gas with the above gas burner.

In the process according to the invention the gas burner is operated in such a manner that the ratio between the gas velocity of the gaseous fuel in the outflow nozzles and the velocity of oxygen or oxygen-containing gas in the restriction is between 3.5 C and 4.0 C, in which C = density of oxygen or oxygen-containing gas/density of the gaseous fuel the densities being related to the conditions in the part of the gas burner before the combustion chamber.

BRIEF DESCRIPTION OF THE DRAWINGS

The invention will be further illustrated with reference to the drawings.

DESCRIPTION OF A PREFERRED EMBODIMENT

Figure 1:
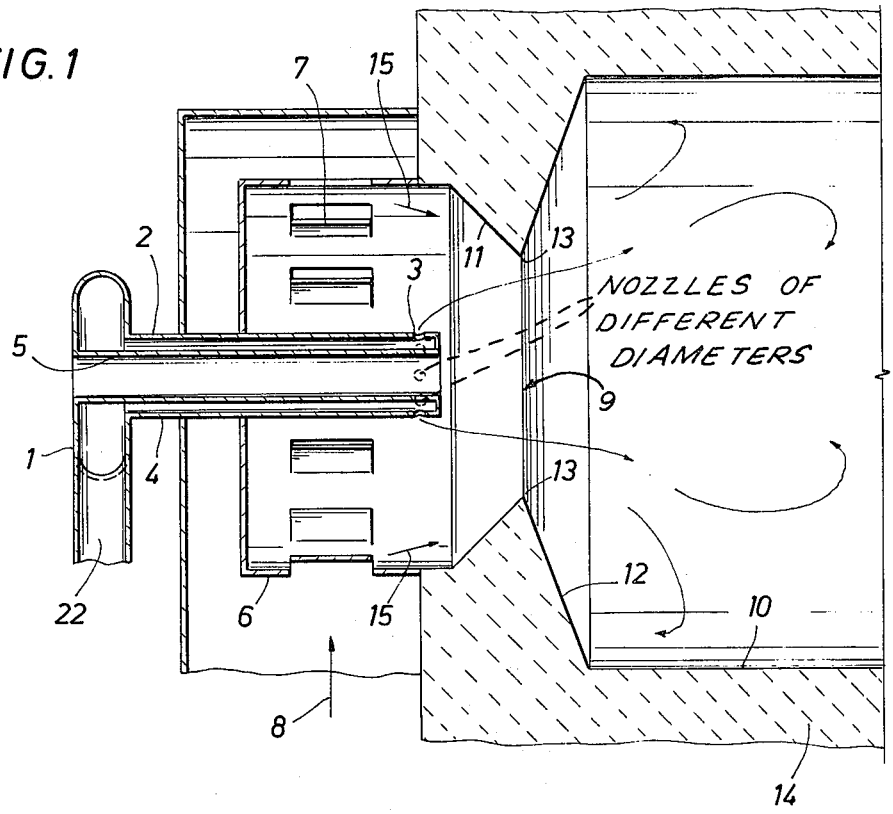
FIG. 1 is a diagrammatic axial cross-section of a gas burner according to the invention.

As is shown in FIG. 1, the gas burner comprises a burner gun 1, connected via inlet 22 to a compressor (not shown) for the supply of a pressurized gaseous fuel. Burner gun 1 has a hollow, double-walled barrel 2, in which nozzles 3 are provided in the outer wall 4 of the barrel near the closed front-end thereof. The gaseous fuel is supplied between the outer wall 4 and the inner wall 5 of the barrel.

The gas burner further has an air chamber 6 with blade-shaped openings 7 through which the air is tangentially introduced. Air is passed to air chamber 6 in the direction of arrow 8 by an air compressor (not shown). Within the air chamber and around barrel 2 of the burner gun the air performs a helical movement with a component which is axially directed forward.

Air chamber 6 debouches into a combustion chamber 10 via a combustion mouth 9. Combustion mouth 9 consists of a convergent wall 11, a divergent wall 12 and a restriction 13 in between. The combustion mouth and the combustion chamber are lined with refractory material 14. The gas burner is connected via its combustion chamber to a reaction chamber (not shown).

The operation of the gas burner shown in FIG. 1 is as follows. Gaseous fuel is pumped through inlet 22 between walls 4 and 5 of the gun barrel. The gaseous fuel leaves the burner gun 1 via nozzles 3 as a number of separate gas jets, the path of which is shown diagrammatically.

The gas jets meet and are mixed with an air stream flowing in the direction of arrows 15 from air chamber 6, via combustion mouth 9 to combustion chamber 10. The velocity of the gas jets is so chosen that they penetrate into the air stream and are mixed sufficiently with the stream. This gas velocity may be varied by means of the pressure drop across the burner gun. It is also of importance that the gas is distributed over a substantial number of gas jets in order to obtain, viewed along the circumference, as even as possible a distribution of the gas to be mixed. The latter also depends on the choice of the number of nozzles in the barrel of the burner gun.

The effect of the nozzles will be shown below by means of the results of a number of experiments aimed at the optimalization of a gas burner.

For the catalytic reduction of sulphur dioxide, for which a soot-free, CO- and $H_2$-containing, reducing gas has to be produced by partial combustion of natural gas in a gas burner of the invention, measurements have been carried out on an air model of the burner of FIG. 1.

The object of these measurements is to investigate what burner configuration gives the best mixing of gas and combustion air, because good mixing is expected to suppress soot formation.

A burner of the type shown in FIG. 1, but with an annular slit as outflow opening for the gaseous fuel in the barrel of the burner gun, is not so suitable for partial combustion if it is desired to obtain a substantially soot-free combustion gas. With this "slit-type burner" the mixing of the gas and the combustion air is extremely poor, which results in a stable, smoky flame. The flame contains a variety of gas/air ratios, both a stoichiometric ratio with a soot-forming effect.

Soot-formation during partial combustion can be prevented by mixing gas and air intimately. The same gas/air ratio is then present throughout and as long as this average ratio does not fall below the soot limit — which may be for example about 64% of the quantity of oxygen stoichiometrically required for propane - no soot will be formed. This sub-stoichiometric flame, however, will be very instable and be easily extinguished.

Extinction of the flame can be prevented by ensuring that the centre of the flame has a lower gas concentration. The desired gas concentration profile, measured across the restriction of the combustion mouth of the gas burner, is a straight line with a small decline in the centre. The said restriction is the place where the combustion usually begins.

With the air model of the gas burner it is possible to simulate the mixing of the gas and the combustion air and determine the gas concentration profile. Tests with this model have been performed to optimalize the shape and location of the outflow nozzles of the burner gun in such a way that the ideal gas concentration profile is approached as closely as possible. In the tests variation was made in the number and the diameter of the nozzles as well as in the retraction, i.e. the distance between the front-end of the barrel of the burner gun and the plane through the restruction of the annular combustion mouth.

EXAMPLE 1

In the test with the air model use was made of a gas burner of the type of FIG. 1, in which the front part of the barrel of the burner gun, containing the outflow nozzles, was removably screwed on and was replaced in each test by an adapted front part with different outflow nozzles.

In all these tests the burner gun had a diameter of 60 mm and the diameter of the restriction in the annular combustion mouth was invariably 94 mm; 930 $m^3/h$ of combustion air were supplied through air chamber 6 by means of a compressor. The gaseous "fuel" was simulated and consisted of pressurized air (80 $m^3/h$) to which 3.3% of helium had been added. This mixture was supplied to burner gun 1 via inlet 22. In the following, the term gas invariably means the helium/air mixture originating from the burner gun. In the tests it was assumed that the flow pattern in the burner up to the restriction in the combustion mouth is not affected by the outflowing gases being or not being combusted.

The helium concentration, measured at a point in the restriction of the combustion mouth, is therefore a measure for the mixing of gas and combustion air. This concentration was measured with a katharometer with which the conductivity of the gas was determined. This value changes with the helium concentration. The gas, the helium concentration of which had to be determined, was drawn off through a probe and a suction line with the aid of diaphragm pump. The gas velocity was determined each time with a cylinder pitot tube.

All the concentration measurements were performed across the restriction along a line through the centre of the burner. All the tests, except the sixth one, were carried out with an average gas concentration of $(80/(930 + 80)) \times 100\% = 7.9\%$.

TEST 1

The gas concentration profile of the conventional gas burner with an annular slit in the barrel of the burner was determined first. The width of the slit was 2 mm and the retraction R (distance between the front-end of the barrel and the plane through the restriction) was 30 and 50 mm respectively. The speed V of the gas was 59 m/second. The results of the gas concentration measurements are plotted in the graph of FIG. 2. In this graph and the following graphs the gas concentration is plotted in % against the distance from the point of measurement to a certain fixed point of the restriction of the combustion mouth. The average gas concentration is plotted in % against the distance from the point of measurement to a certain fixed point of the restriction of the combustion mouth. The average gas concentration of 7.9%, which would have been obtained as a straight line in intimate mixing, is also plotted in this graph and the following graphs.

Figure 2:
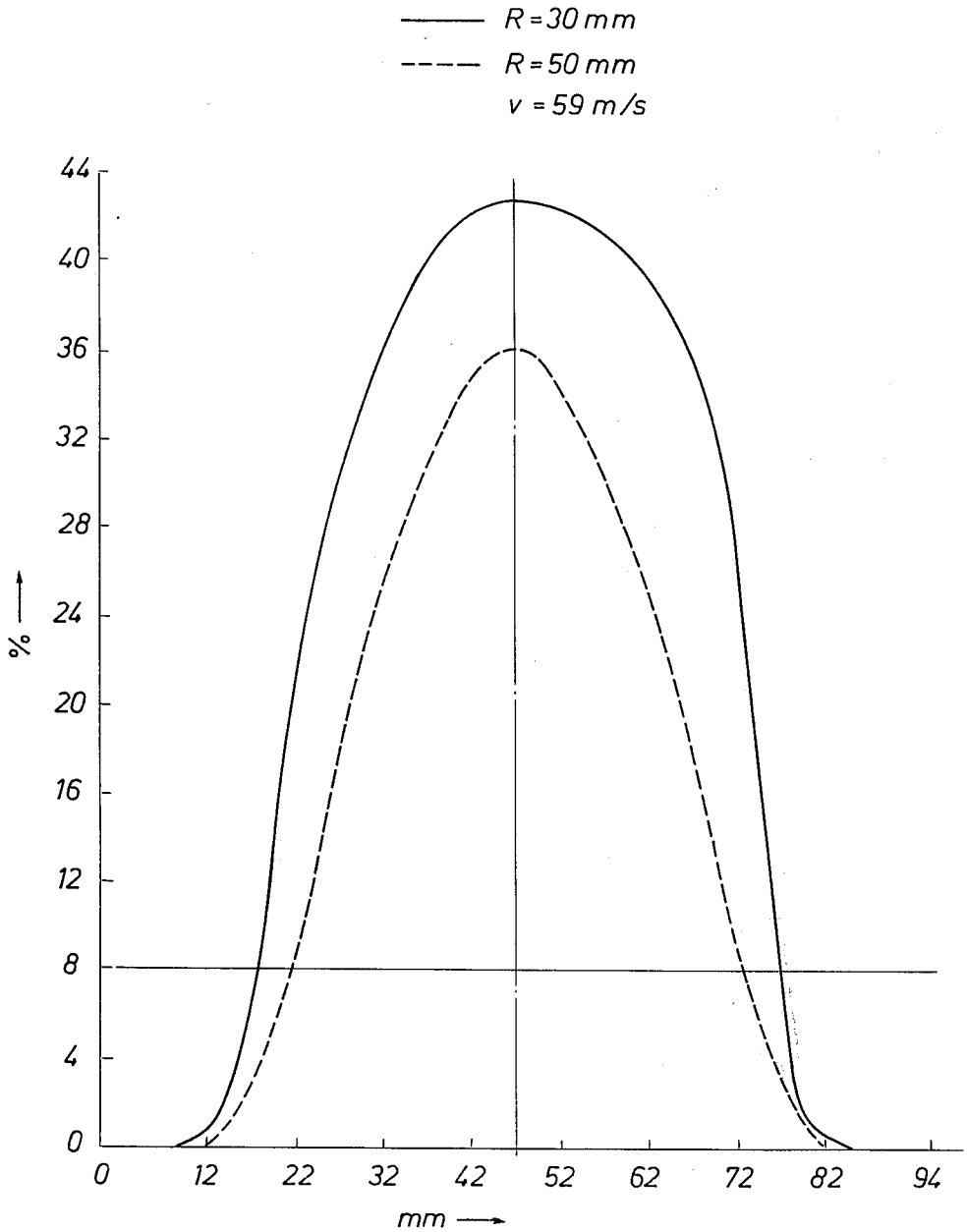
FIG. 2 is a diagram of the distribution of the gas concentration in a gas burner along a centre line through the restriction of its combustion mouth, the burner having a barrel with an annular slit.

The graphs of FIG. 2 shows that in the conventional burner the mixing of the gas with the combustion air is extremely poor. There is no gas at all near the edge of the restriction, while that is where the largest quantity of air passes.

TEST 2

Figure 3:
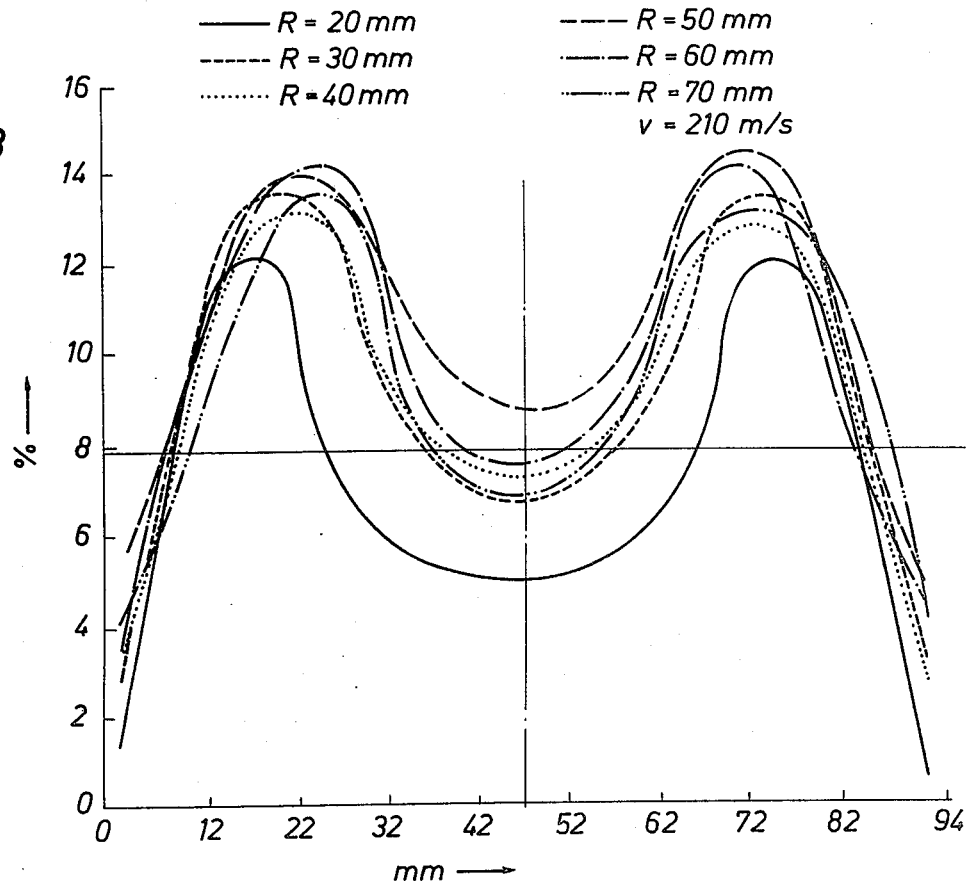
FIG. 3 is a diagram of the distribution of the gas concentration in a gas burner along a centre line through the restriction of its combustion mouth, the gas burner having 15 nozzles of 3 mm diameter.

In the second test use was made of a burner barrel with 15 separate nozzles with a diameter of 3 mm at a distance of 10 mm from the front end. The barrel was located in the gas burner at a retraction R of 20, 30, 40, 50, 60 and 70 mm respectively. The velocity V of the gas was in all cases 210 m/second. The results are shown in the graph of FIG. 3.

The improvement is manifest compared with the slit-type burner with which the results of FIG. 2 were obtained. Nevertheless, the gas jets do not penetrate far enough into the air flowing along the combustion mouth, so that the gas concentration remains too low in the zone adjacent to the inner wall of the combustion mouth. According to the invention a larger diameter of the nozzles is a solution of this problem. FIG. 3 further shows the effect of the retraction R, but that is not substantial.

TEST 3

Further to the foregoing a third test was carried out, use being made of a gun barrel with 6 nozzles having a diameter of 5 mm. The retraction R of the barrel was 40, 50 and 60 mm respectively. The speed V of the gas was 189 m/second.

Figure 4:
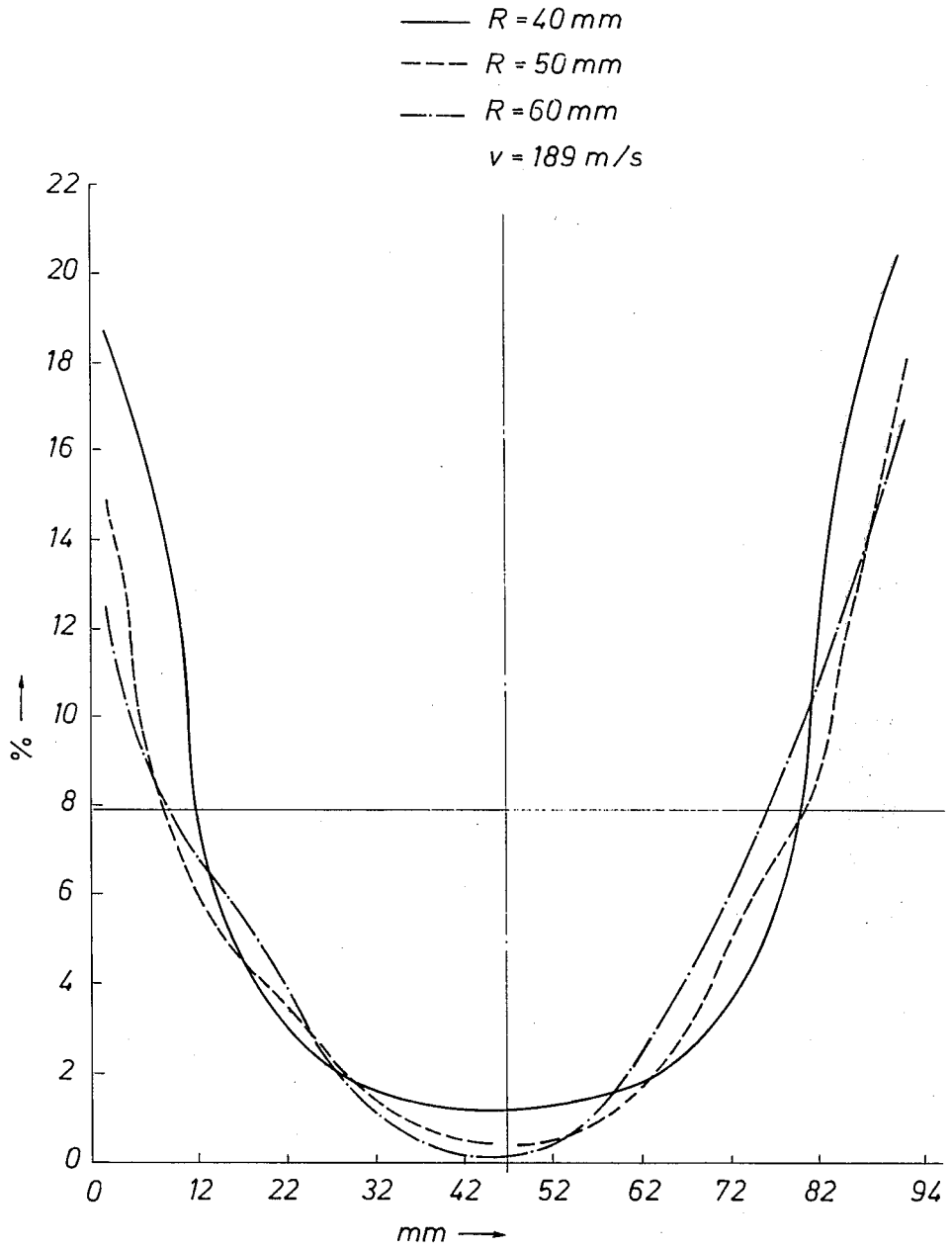
FIG. 4 shows a similar diagram for a gas burner having 6 nozzles of 5 mm diameter.

The results of the measurement of the gas concentration are shown in the graph of FIG. 4 and demonstrate that the gas jets penetrate too far into the air stream flowing through the combustion mouth. This can be remedied by reducing the gas velocity, as appears from the next test.

TEST 4

In the next test, the fourth, an additional number of 3 mm nozzles were drilled in the barrel, so that at a quantity of 80 $m^3$ of gas per hour the gas velocity from the nozzles was about 100 m/second. This fourth test therefore relates to a barrel having 6 nozzles with a diameter of 5 mm and 12 nozzles with a diameter of 3 mm. The retraction R was 30, 40 and 50 mm respectively; the gas velocity was 110 m/second.

Figure 5:
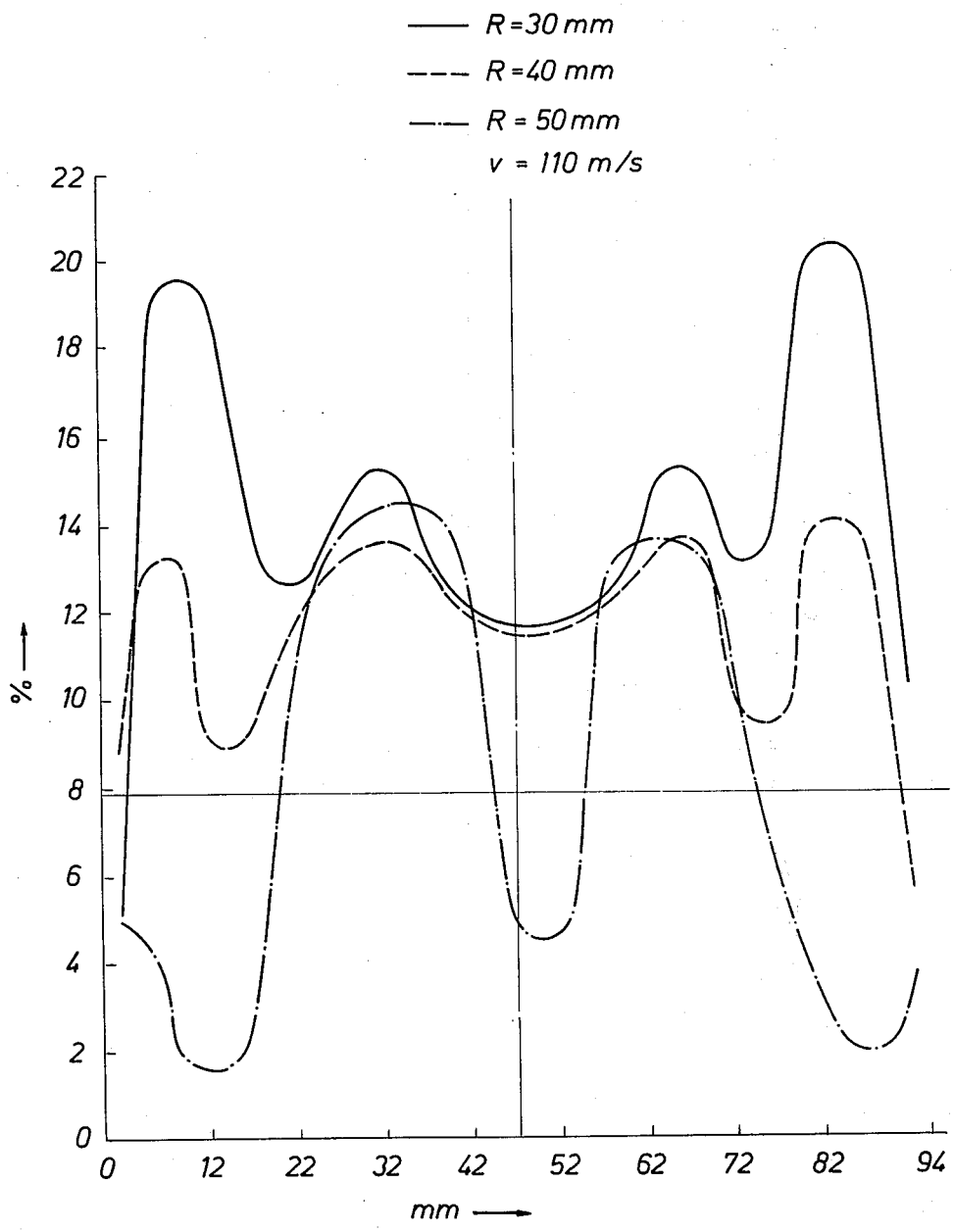
FIG. 5 shows a similar diagram for a gas burner with 6 nozzles of 5 mm and 12 mozzles of 3 mm diameter.

The gas concentrations measured in the combustion mouth are plotted in the graph of FIG. 5. This graph shows that the change in the retraction R affects the mixture. In order to reduce the peaks in the gas concentration at 15 mm from the centre and also the irregular distribution along the circumference the number of 3 mm nozzles was decreased.

TEST 5

The same test now related to a burner barrel provided with 6 nozzles with a diameter of 5 mm and 6 nozzles with a diameter of 3 mm. The retraction R was 30, 40 and 50 mm respectively and the gas velocity 139 mm/second.

Figure 6:
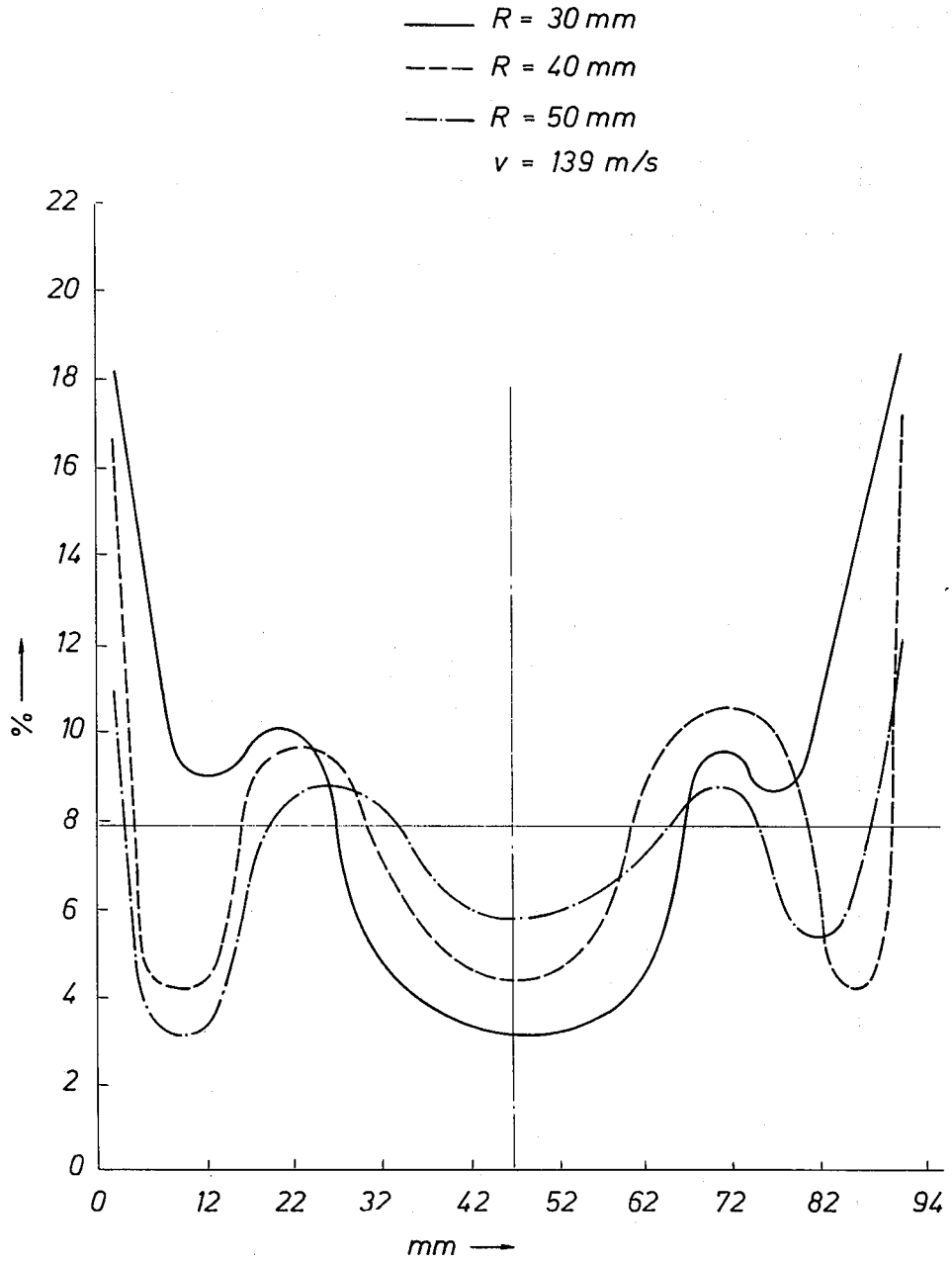
FIG. 6 shows a similar diagram for a gas burner with 6 nozzles of 5 mm and 6 nozzles of 3 mm diameter.

The gas concentrations measured are plotted in the graph of FIG. 6 which shows that the peaks have indeed disappeared at 15 mm from the centre. Moreover, the effect of the change in the retraction has been reduced.

As a result of the increased gas velocity the gas jets originating from the nozzles with a diameter of 5 mm penetrate too far, so that too high a gas concentration develops near the wall of the combustion mouth.

TEST 6

In the sixth test the six nozzles with a diameter of 5 mm were therefore replaced by six nozzles with a diameter of 4.5 mm, so that the gas burner had two groups of six nozzles with different diameter. A test was performed at a gas velocity V of 139 m/second, both at a retraction R of 50 mm and of 40 mm. Moreover at R = 50 mm a test at a gas velocity V = 161 m/second and at R = 40 mm a test at a gas velocity V = 121 m/second. In the above-mentioned three cases the average (calculated) gas conentration was at V = 161 m/second 7.9%, at V = 139 m/second 6.8% and at V = 121 m/second 6.1% respectively.

Figure 7:
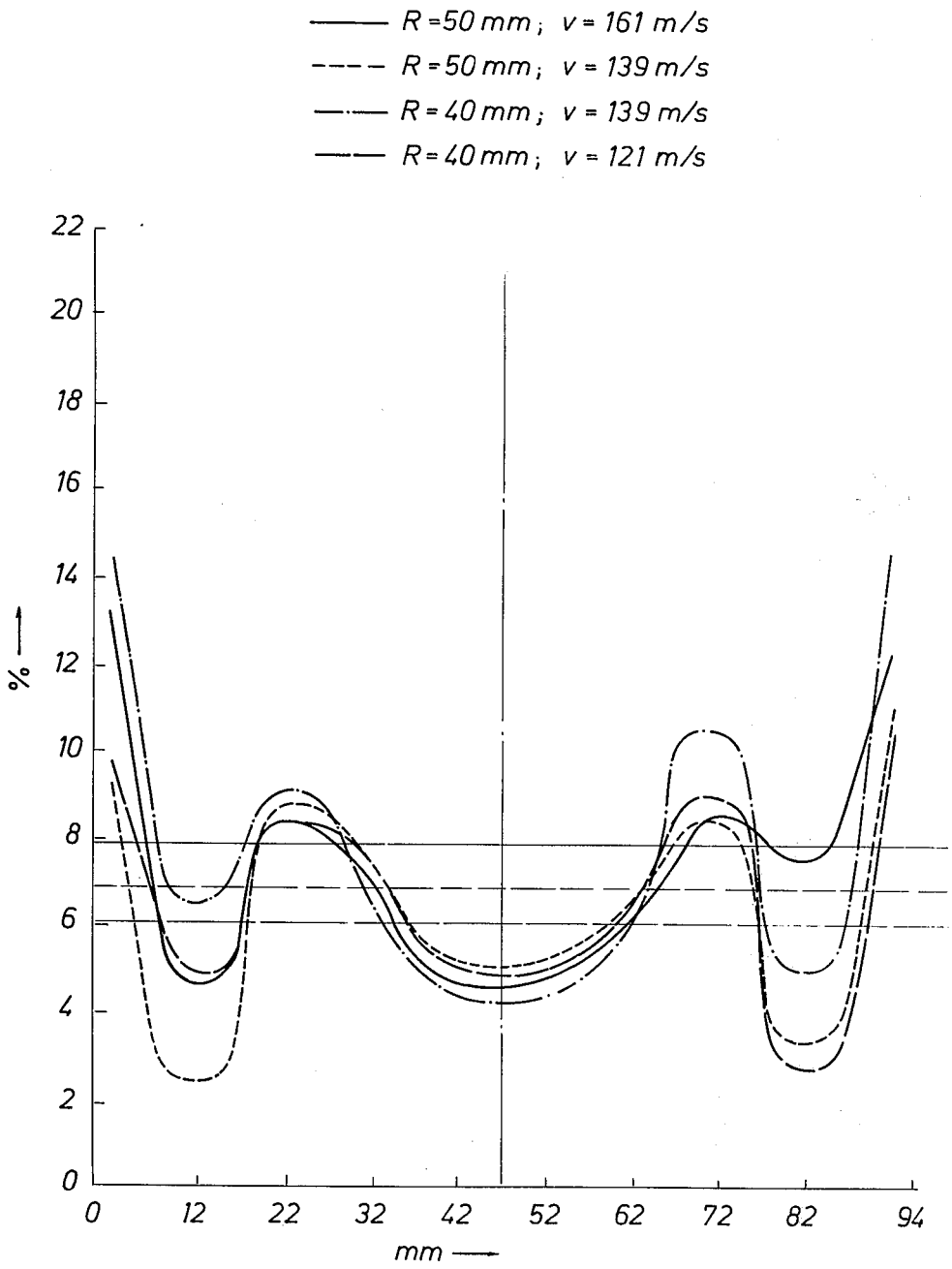
FIG. 7 shows a similar diagram for a gas burner with 6 nozzles of 4.5 mm and 6 nozzles of 3 mm diameter.

The gas concentrations measured are plotted in the graph of FIG. 7. Also here a maximum was measured near the wall of the combustion mouth, whereas a minimum gas concentration had developed at 35 mm from the centre.

TEST 7

In the seventh test the 3-mm nozzles in the burner of the previous test were enlarged to 3.5 mm, since the inner jets were then expected to penetrate further and increase the above-mentioned minimum. Owing to the reduced velocity the maximum on the edges will decrease. The seventh test therefore related to a burner barrel with 6 nozzles having a diameter of 4.5 mm and 6 nozzles with a diameter of 3.5 mm. The retraction R was 50 mm and the gas velocity was 145 m/second.

The gas concentration was measured twice under these conditions, the position of the burner barrel being different for the two measurements as a result of the barrel being rotated through an angle of 30° around its axis between the measurements.

Figure 8:
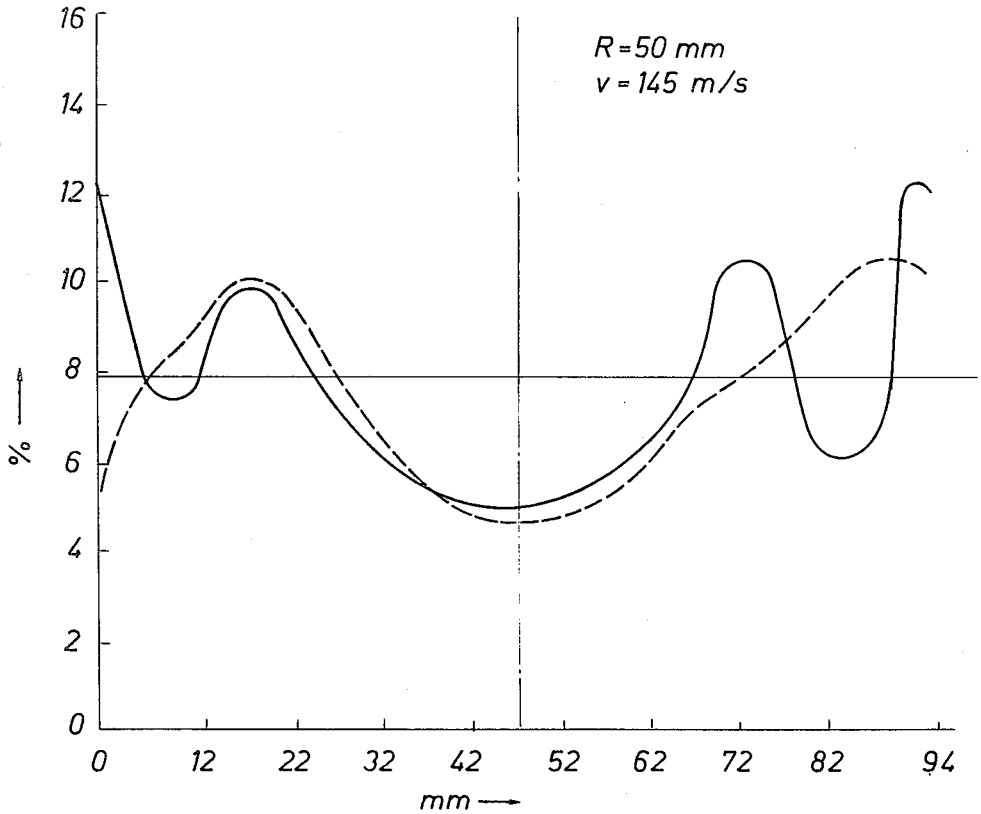
FIG. 8 shows a similar diagram for a gas burner with 6 nozzles of 4.5 mm and 6 nozzles of 3.5 mm diameter.

The results shown in the graph of FIG. 8 demonstrate that the concentration profile of this burner configuration may be described as reasonable. According to both curves, however, the distribution of the gas concentration viewed in the direction of the circumference of the combustion mouth is not uniform. In order to obtain a better idea of this distribution along the circumference, measurements of the gas concentration were performed at 2 mm from the inner wall of the combustion mouth, the gun barrel each time being rotated 10°.

Figure 9:
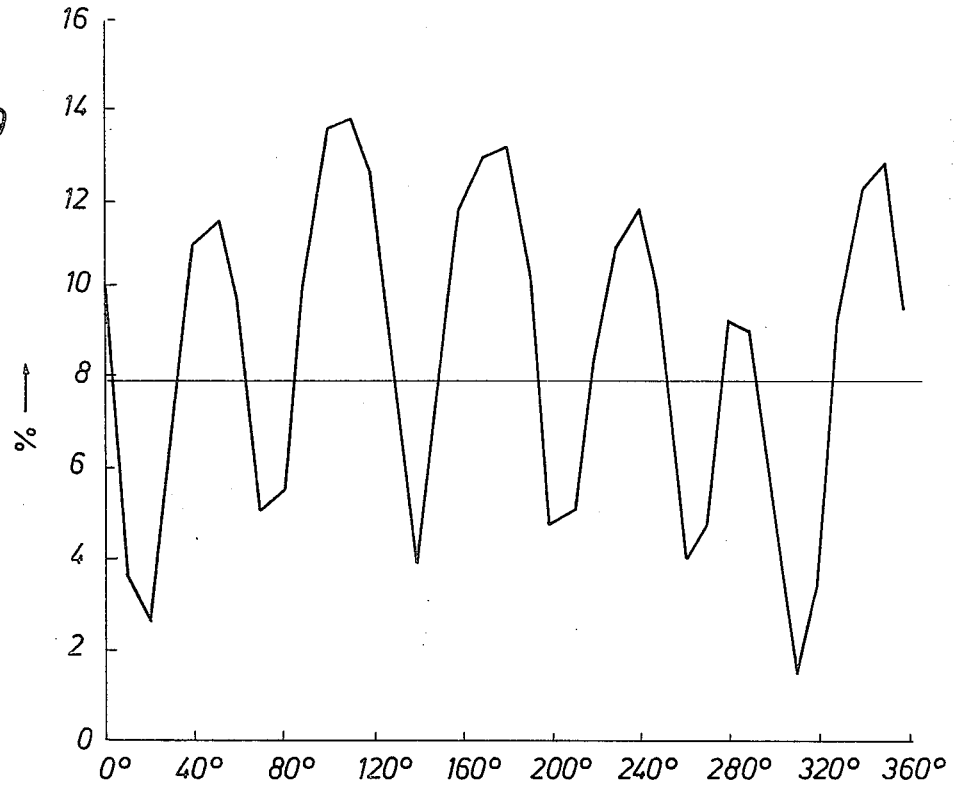
FIG. 9 shows diagrammatically the gas concentration distribution for the gas burner of FIG. 8 on a distance of 2 mm from the inner wall of the annular combustion mouth along the circumference of the restriction.

From the results of these measurements, which are represented in the graph of FIG. 9, it appears that the number of jets which have to supply the edge zones with gas, which gas originates from the 6 nozzles with a diameter of 4.5 mm, is too small.

TEST 8

In order to remove this drawback the number of large nozzles in the gun barrel was increased in the next test. This eighth test therefore related to a burner barrel having 4 nozzles with a diameter of 3 mm and 8 nozzles with a diameter of 4 mm. The retraction R in all cases was 50 mm and the gas velocity 174 m/second. The first two series of measurements, which are incorporated in FIG. 10, related to two positions of the burner barrel with 40° rotation with respect to each other. The third series of measurements related to measurements of the gas concentration at 2 mm from the wall of the combustion mouth, the gun barrel each time being rotated around its axes through an angle of 10°. The results of these measurements are incorporated in FIG. 11.

Figure 10:
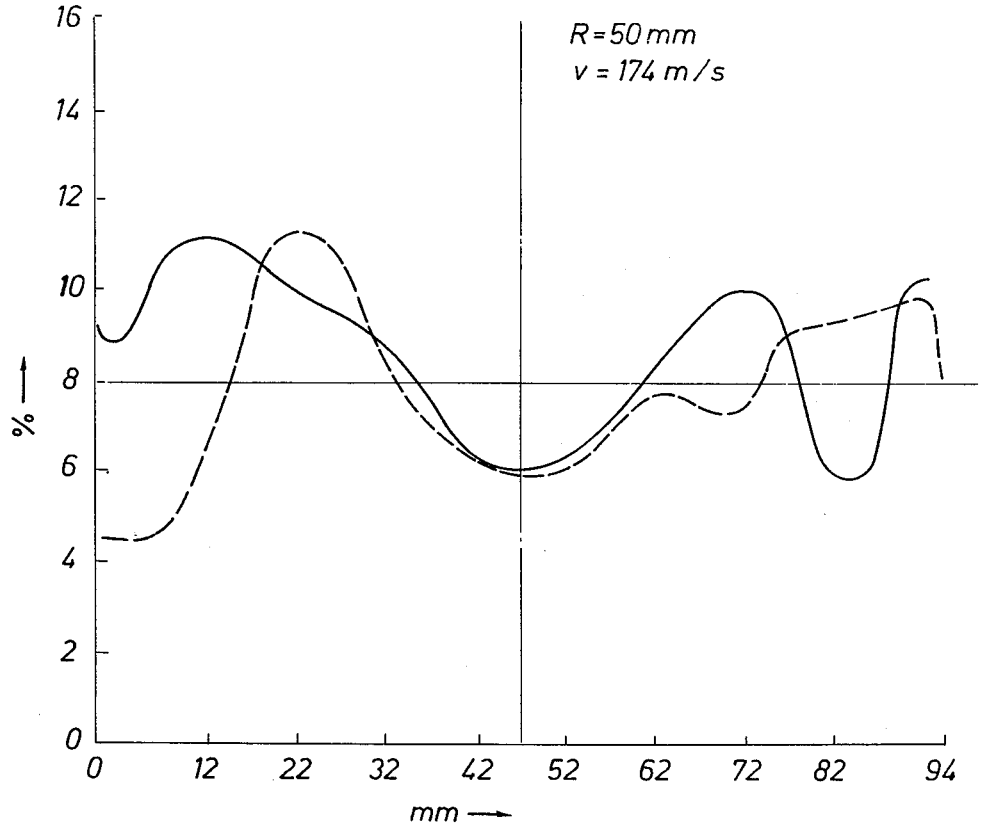
FIG. 10 shows a gas concentration distribution diagram similarly as in FIG. 3 for a gas burner with 4 nozzles of 3 mm and 8 nozzles of 4 mm diameter.
Figure 11:
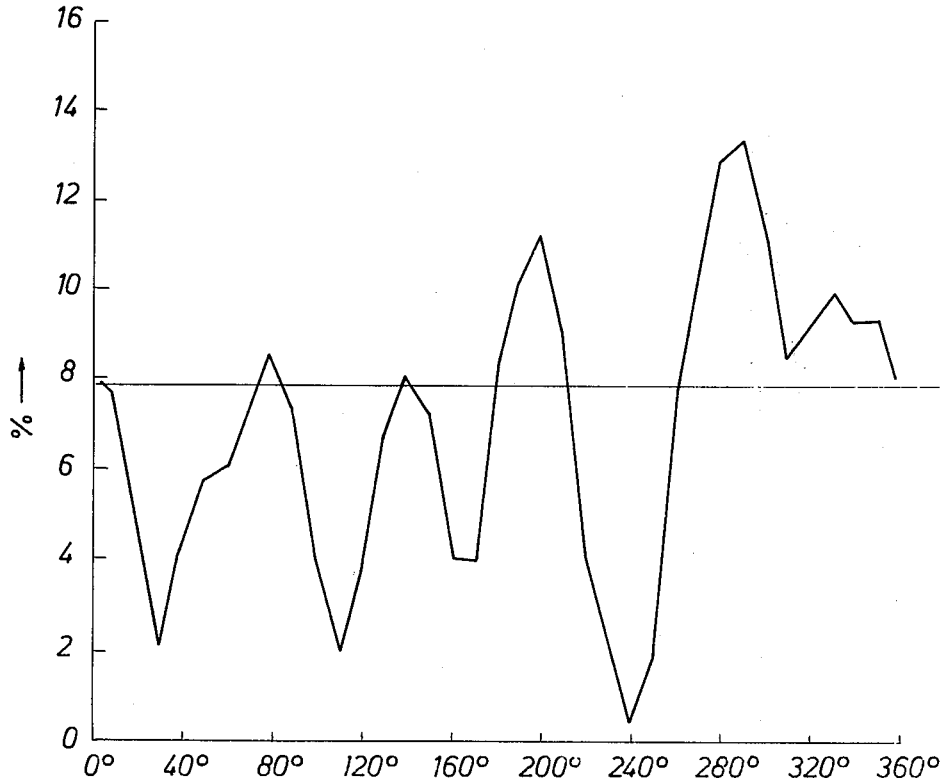
FIG. 11 shows similarly as in FIG. 9 the gas concentration distribution along the circumference of the restriction for the gas burner of FIG. 10.

FIG. 10 shows that the distribution of the gas concentration is reasonable in this burner configuration. FIG. 11 moreover proves that the gas concentration distribution in the circumference is improved compared with that of FIG. 9, since thepeaks are less high and the general gas concentration is more favourable with respect to the average concentration.

EXAMPLE 2

A gas burner of the type of FIG. 1, having a burner gun with a diameter of 60 mm and two groups of 13 nozzles with different diameter, was used for the partial combustion of natural gas with air. The nozzles of the one group had a diameter of 4.5 mm and the nozzles of the other group a diameter of 3.5 mm. The nozzles were at a distance of 10 mm from the closed front-end of the barrel. The retraction R of the gun barrel was 50 mm and the diameter of the restriction in the annular combustion mouth was 94 mm.

The characteristics of the gas burner were:

$$\frac{\text{diameter of restriction}}{\text{distance plane through nozzles to plane through restriction}} = \frac{94}{60} = 1.57$$

$$\frac{\text{distance nozzles to front-end of barrel}}{\text{diameter of restriction}} = \frac{10}{94} = 0.106$$

$$\frac{\text{diameter of gun barrel}}{\text{diameter of restriction}} = \frac{60}{94} = 0.64$$

$$\frac{\text{diameter of nozzles}}{\text{diameter of restriction}} \quad \text{large} = \frac{4.5}{94} = 0.048$$

$$\text{small} = \frac{3.5}{94} = 0.037$$

With this burner natural gas was combusted to a mixture comprising hydrogen, carbon monoxide and water as combustion products. Different natural gas/air ratios were applied by varying the natural gas flow and/or the air flow. The air flow used was expressed in percentage of stoichiometry, 100% being the amount of air required for complete combustion of the natural gas. The burner was operated at different turn-down ratios or load, at 100% load 100 kg/h of natural gas being combusted. In the wet combustion gas the amount of soot produced was determined at the different turn-down ratios and percentage of stoichiometry applied.

Figure 12:
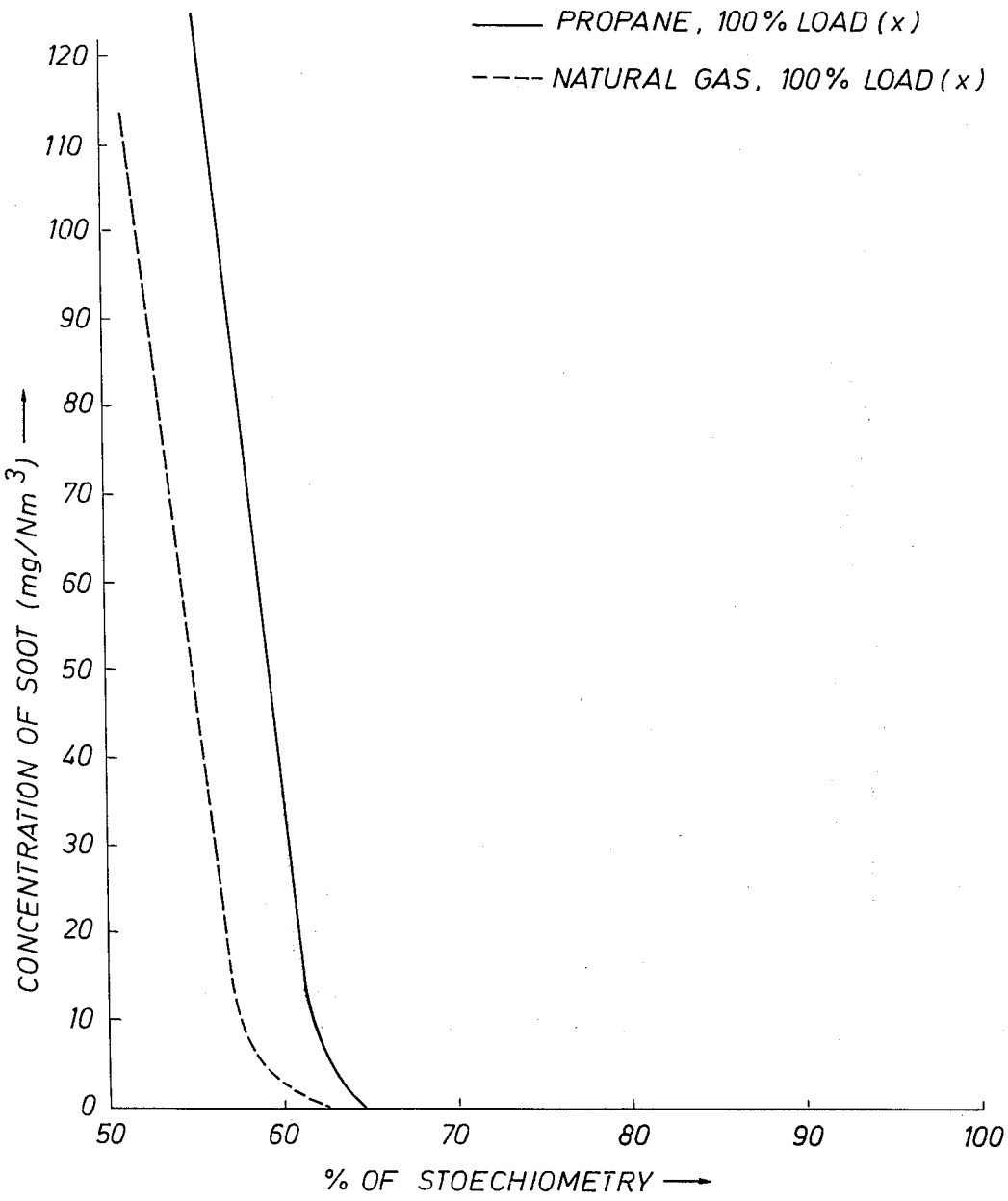
FIG. 12 shows the soot make against the percentage of stoichiometry in a gas burner of the invention with natural gas or propane as the gaseous fuel at 100% load.

The results obtained are given in the table hereinafter. In FIG. 12 the soot contents have graphically been shown for a 100% load. From the results it follows that the gas burner of the invention has an excellent performance at high turn-down ratios and low percentage of stoichiometry, no soot being produced beyond the sooting limits found (dotted line; soot concentration on vertical axis).

EXAMPLE 3

In the gas burner of Example 2 the burner gun was replaced by a gun with a barrel diameter of 60 mm having 8 nozzles of 4.5 mm and 8 nozzles of 3.5 mm. The distance of the nozzles to the closed front-end of the gun barrel was 10 mm and the retraction R was 50 mm. This gas burner was used for the partial combustion of propane with air. At 100% load 100 kg/h of fuel was combusted. The soot content of the combustion gas was determined for different percentages of stoichiometry. The results are given in the table and are graphically shown in FIG. 12 (straight line; soot concentration on vertical axis).

TABLE

| Fuel | Load % | Stoichiometry, % | Soot, mg/Nm³ |
|---|---|---|---|
| Natural Gas | 100 | 64.5 | 0 |
| | | 63.0 | 0 |
| | | 61.0 | 2 |
| | | 59.0 | 3 |
| | | 58.0 | 5 |
| | | 57.4 | 10.5 |
| | | 57.0 | 19 |
| | | 52.5 | 90 |
| | 70 | 67.0 | 0 |
| | | 62.0 | 3 |
| | | 57.5 | 13.5 |
| | 50 | 60.0 | 2.5 |
| | | 53.5 | 110 |
| | 30 | 61.0 | 3.5 |
| | | 57.5 | 44 |
| | 20 | 59.0 | 30 |
| Propane | 100 | 68.5 | 0 |
| | | 65.0 | 0 |
| | | 60.0 | 40 |
| | | 56.0 | 111 |

In Examples 2 and 3 the soot content in the combustion gas was determined as follows:

The combustion gas was sucked off at the outlet of the reaction chamber of the gas burner via an uncooled quartz pipe. After passing through a cooler the gas entered a filter chamber filled with quartz wool, where the soot, if any, was deposited. After being dried the combustion gas passed through a vacuum pump, a gas meter and a rotameter. Before inserting a clean quartz wool filter it was dried and weighed together with the cooler. After the test the filter and cooler were dried at 90° C in vacuum and again weighed together.

I claim as my invention:

1. A gas burner comprising a burner gun, an air chamber around the gun, and a combustion chamber, which air chamber debouches into the combustion chamber via an annular combustion mouth, the burner gun having a cylindrical barrel for the supply of gaseous fuel to the combustion chamber through the said combustion mouth, the annular combustion mouth formed by a convergent inner wall and divergent inner wall located on either side of a restriction situated outside the front-end of the barrel of the burner gun, in which two groups of radial outflow nozzles of different diameters are provided, near the combustion mouth, in the side wall of the burner gun near the closed front-end of the barrel, which nozzles serve to dose gaseous fuel into the oxygen or oxygen-containing gas flowing through the combustion mouth, the nozzles being substantially regularly distributed around the barrel, the axes of the nozzles being in a common plane and being perpendicular to the axis of the barrel, the ratio of the diameter of the outflow nozzles and the diameter of the restriction being between 0.030 and 0.060, with one group of at least 6 outflow nozzles with a diameter smaller than the other group of at least 6 outflow nozzles of larger diameter, the ratio between the diameter of the restriction, and the distance from a plane through the outflow nozzles to a plane through the restriction being between 1.5 and 1.7.

2. A gas burner as claimed in claim 1, characterized in that the ratio between the distance from a plane through the front-end of the barrel to a plane through the outflow nozzles and the diameter of the restriction is between 0.097 and 0.117.

3. A gas burner as claimed in claim 1, characterized in that the ratio between the diameter of the barrel and the diameter of the restriction is between 0.60 and 0.67.

4. A gas burner as claimed in claim 1, characterized in that in the two groups of outflow nozzles with different diameters, each nozzle of a group has the same nozzle diameter.

5. A gas burner as claimed in claim 1, characterized in that the ratio between the diameter of the larger outflow nozzles and the diameter of the restriction lies between 0.045 and 0.050 and that the ratio between the diameter of the smaller outflow nozzles and the diameter of the restriction lies between 0.034 and 0.040.

* * * * *